United States Patent [19]

Rocha

[11] Patent Number: 4,502,684

[45] Date of Patent: Mar. 5, 1985

[54] BATTING PRACTICE DEVICE FOR BASEBALL

[76] Inventor: Emilio Rocha, 1402 Fredericksburg Rd., San Antonio, Tex. 78201

[21] Appl. No.: 503,596

[22] Filed: Jun. 13, 1983

[51] Int. Cl.[3] ..... A63B 69/40

[52] U.S. Cl. ..... 273/26 E

[58] Field of Search ..... 273/26 R, 29 A, 35 R, 273/184 R, 184 B, 185 C, 185 D, 197 R, 181 J, 197 A, 200 B, 411, 413, 26 E

[56] References Cited

U.S. PATENT DOCUMENTS

| | | | |
|---|---|---|---|
| 661,381 | 11/1900 | McHardy | 273/184 B |
| 1,800,934 | 4/1931 | Fox et al. | 273/184 B |
| 1,962,087 | 6/1934 | Cone | 273/26 R |
| 3,861,679 | 1/1975 | Culpepper | 273/29 A |
| 3,942,794 | 3/1976 | Gowins | 273/26 E |
| 4,105,203 | 8/1976 | Cho | 273/29 A |

*Primary Examiner*—Richard C. Pinkham
*Assistant Examiner*—T. Brown
*Attorney, Agent, or Firm*—Ranseler O. Wyatt

[57] ABSTRACT

A batting practice device for baseball having a base member and a telescoping vertical shaft, with a laterally extended tubular member mounted on the extended end of said shaft and rotatable thereon with a pair of springs resisting the rotatable movement in two directions to yieldably maintain the said tubular member against rotation. A yieldable band such as a strip of rubber or other elastic, is secured adjacent the inner end of said tubular member and extends through said member, and a ball, similar to a baseball, is secured to the other end of said elastic strip and is suspended as a batting target.

3 Claims, 3 Drawing Figures

BATTING PRACTICE DEVICE FOR BASEBALL

BACKGROUND OF THE INVENTION

Due to the popularity of the game of baseball, many devices have been designed to provide practice in varied aspects of the game, particularly in batting. Mechanical devices for swinging balls and projected balls and the like are well known, where several players are needed to activate the device. It is the object of this invention to provide a standing batting practice device that requires only the player practicing to use, and which may be used by either right or left handed players.

SUMMARY OF THE INVENTION

In a batting practice device for baseball, a base member, a vertically adjustable upstanding shaft mounted on said base member, having a laterally extended tubular arm mounted on the extended end thereof, said arm being rotatably mounted on said shaft and having rotation resisting means for yieldably maintaining said arm in one position and means on said vertical shaft limiting the rotation of said arm in either direction; said arm having a strip of yieldable material anchored adjacent one end and extending through said arm and a baseball suspended from the other end of said yieldable strip.

DESCRIPTION OF THE PREFERRED EMBODIMENT

Figure 1:
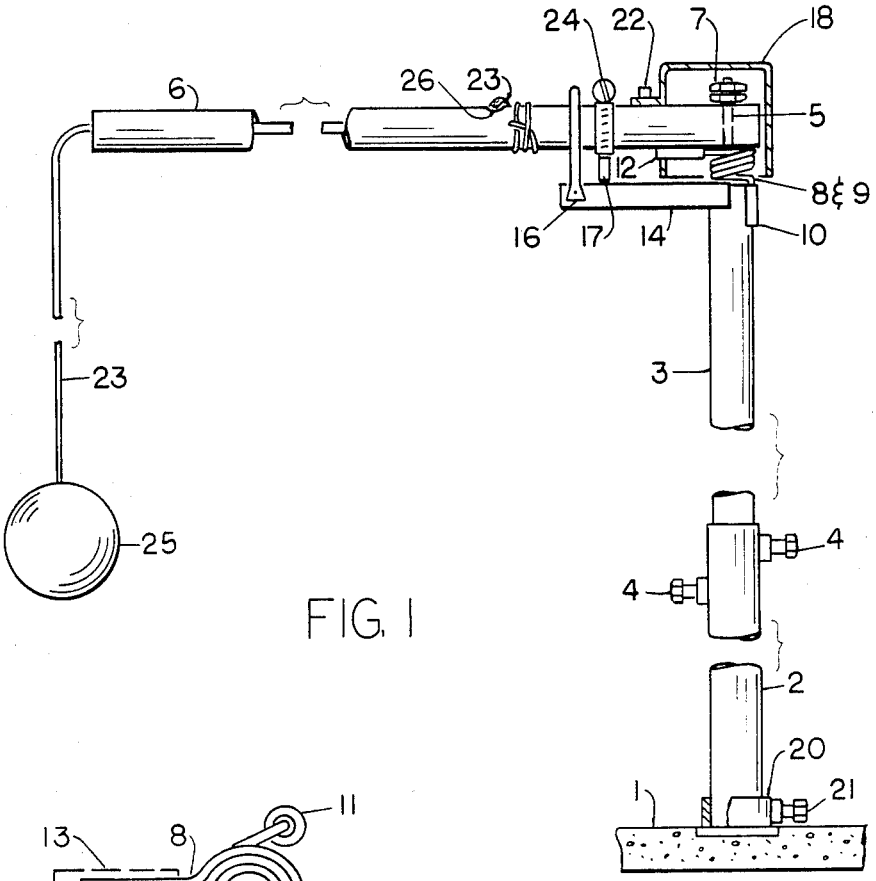
FIG. 1 is a side elevational view of the device.
Figure 2:
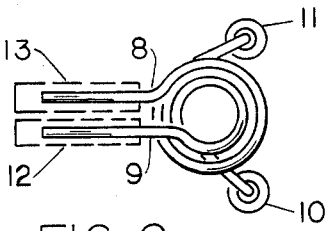
FIG. 2 is an enlarged fragmentary view illustrating yieldable means for maintaining the arm in position for batting practice.
Figure 3:
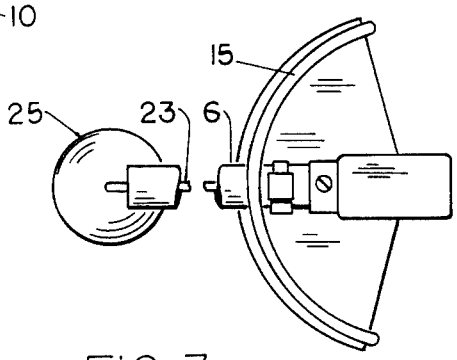
FIG. 3 is a plan view of the platform and rail portion of Fig. 1.

In the drawings the numeral 1 designates a base member, which may be of heavy metal or concrete, having a vertical socket 20 fixedly mounted therein, and the shaft member 2 releasably mounted in said socket by means of the set screw 21 and which may have one or more tubular telescoping extensions 3. Set screws as 4 4, lock the members of the shaft in the desired position, according to the height of the user.

On the upper end of the shaft 3 is the vertical externally threaded pin 5 which extends through a port in the laterally extended arm 6. The nut 7 maintains the arm 6 in position on the shaft member 3. Concentric springs 8, 9 having their lower ends mounted in the retainers 10, 11 and the upper ends mounted in the retainer 12, 13 yieldably counter the rotation of the arms 6 in either direction, and maintains the arm 6 in a substantially central position. A platform 14 anchored to the shaft member 3 has the guardrail 15 and stop members 16, 16 confining the movement of the arm 6. A roller 17 mounted on the arm 6 as by means of the clamp 26, and resting on the platform 14, supports the arm in its lateral movement. A cap 18 is mounted over the nut 7 and juncture of the shaft member 3 and arm 6 and is secured in position on the arm 6 by the screw 22. An elastic strap 23 is anchored to the arm 6, as by tying a knot in the extended end or otherwise securing same on the arm 6 and is threaded through the port 26 into the arm 6 and extends through the arm 6 and has the baseball 25 on the extended end thereof.

In use the batter stands in the desired position adjacent the suspended ball and strikes the ball with the usual baseball bat (not shown) and the ball stretches the strap 23 and moves the arm 6 in the direction the ball travels against the resistence of the strap 23 and the springs 8 or 9, with a stop 16 or 17 limiting the lateral movement of the arm 6. The arm will be returned to central position by the springs 16, 17 and the ball will be again suspended, preparatory to another blow from the bat. When the practice is over, the device may be quickly disassembled and stored for future use.

What I claim is:

1. In a batting practice for baseball, a base member, telescoping vertical shaft members mountable on said base member, a laterally extended arm rotatably mounted on said shaft member, means for maintaining said arm in a central position, a yieldable strap having one end mounted on said arm and a baseball mounted on the other end of said strap, means for resisting lateral movement of said laterally extended arm and means for limiting said movement in either direction, said means for resisting lateral movement of said arm having a pair of concentrically mounted springs, the end of which are mounted on said vertical shaft, and on said laterally extended arm, respectively.

2. The device as defined in claim 1 wherein one of said springs resisting rotation of said arm in one direction and the other spring resisting rotation of said arm in the other direction.

3. The device as defined in claim 2 wherein a semicircular platform is mounted on said shaft member having stop means at each end limiting the movement of the laterally extended arm and a roller mounted on said arm and bearing against said platform to support said laterally extended arm.

* * * * *